US007466328B2

(12) United States Patent
Burdenko et al.

(10) Patent No.: US 7,466,328 B2
(45) Date of Patent: Dec. 16, 2008

(54) THERMAL PRINTING DEVICE WITH AN IMPROVED IMAGE REGISTRATION, METHOD FOR PRINTING AN IMAGE USING SAID PRINTING DEVICE AND SYSTEM FOR PRINTING AN IMAGE

(75) Inventors: Michael N. Burdenko, Wellesley, MA (US); Walter P. Haimberger, Topsfield, MA (US); Dana F. Schuh, Windham, NH (US); Stephen J. Telfer, Arlington, MA (US); William T. Vetterling, Lexington, MA (US)

(73) Assignee: Polaroid Corporation, Concord, MA (US)

( * ) Notice: Subject to any disclaimer, the term of this patent is extended or adjusted under 35 U.S.C. 154(b) by 379 days.

(21) Appl. No.: 11/274,008

(22) Filed: Nov. 14, 2005

(65) Prior Publication Data

US 2006/0103709 A1 May 18, 2006

Related U.S. Application Data

(60) Provisional application No. 60/627,909, filed on Nov. 16, 2004.

(51) Int. Cl.
*B41J 2/32* (2006.01)
*B41J 3/60* (2006.01)

(52) U.S. Cl. ..... 347/171

(58) Field of Classification Search ..... 347/171, 347/172, 175; 400/120.01, 188
See application file for complete search history.

(56) References Cited

U.S. PATENT DOCUMENTS 4,811,036 A 3/1989 Gaskill et al. ..... 346/76 PH
4,857,941 A 8/1989 Kaida ..... 346/76 PH
4,932,798 A 6/1990 Kardinal et al. ..... 400/120
4,940,993 A 7/1990 Sato ..... 346/76 PH
4,956,251 A 9/1990 Washizu et al. ..... 430/138
4,962,386 A 10/1990 Hakkaku et al. ..... 346/1.1
5,095,316 A 3/1992 Hakkaku ..... 346/1.1
5,101,222 A 3/1992 Hakkaku ..... 346/76 PH
5,284,816 A 2/1994 Stephenson ..... 503/227
5,486,057 A 1/1996 Skinner et al. ..... 400/120.02
5,550,572 A 8/1996 Chang et al. ..... 347/171
5,558,449 A 9/1996 Morgavi ..... 400/188
5,600,362 A 2/1997 Morgavi et al. ..... 347/218
5,675,369 A 10/1997 Gaskill ..... 347/171

(Continued)

FOREIGN PATENT DOCUMENTS

EP 0 785 079 B1 6/2000

(Continued)

*Primary Examiner*—Huan H Tran

(57) ABSTRACT

A printing device that includes a platen for supporting an imaging member during a printing operation and at least one print head subassembly for direct thermal printing on the imaging member. The print head subassembly is configured to be movable independently of the platen for printing on a first surface of the imaging member in a first transport path and on a second surface of the imaging member in a second transport path. The printing device also includes at least one driving roller for driving the imaging member during the printing operation that is configured to drive the imaging member through a driving nip created by the driving roller with a substantially constant degree of wrap wherein the distance of transport of said imaging member for a given angular rotation of said driving roller is substantially the same for the first transport path and the second transport path.

9 Claims, 16 Drawing Sheets

U.S. PATENT DOCUMENTS

| | | | | |
|---|---|---|---|---|
| 5,677,722 | A | 10/1997 | Park | 347/218 |
| 5,973,711 | A | 10/1999 | Schartner et al. | 347/173 |
| 6,046,756 | A | 4/2000 | Iga et al. | 347/173 |
| 6,296,405 | B1 | 10/2001 | Brewington et al. | 400/188 |
| 6,601,952 | B2 | 8/2003 | Sugioka et al. | 347/104 |
| 6,801,233 | B2 | 10/2004 | Bhatt et al. | 347/175 |
| 7,198,419 | B2 * | 4/2007 | Lee | 400/120.16 |
| 2001/0021331 | A1 | 9/2001 | Brewington et al. | 400/188 |

FOREIGN PATENT DOCUMENTS

| | | |
|---|---|---|
| EP | 1 621 356 A1 | 2/2006 |
| FR | 2 773 547 | 7/1999 |
| JP | 59-020688 | 2/1984 |
| JP | 05-131702 | 5/1993 |

* cited by examiner

THERMAL PRINTING DEVICE WITH AN IMPROVED IMAGE REGISTRATION, METHOD FOR PRINTING AN IMAGE USING SAID PRINTING DEVICE AND SYSTEM FOR PRINTING AN IMAGE

REFERENCE TO RELATED APPLICATION

This application claims the benefit of provisional application Ser. No. 60/627,909, filed Nov. 16, 2004.

BACKGROUND OF THE INVENTION

1. Field of the Invention

The present invention relates generally to thermal printing devices. More specifically, the present invention relates to a thermal printing device, a method for printing a multicolored image using the printing device and a system for printing multicolored images.

2. Description of Related Art

Various conventional printing devices include a printing head that is capable of transferring a colorant to a substrate. Several different techniques may be used for the transfer of colorant, including ink jet, electrostatic toner transfer, and thermal transfer. Printing devices using these techniques can print a single or more than one color, and may print onto individual or continuous sheets that may be opaque or transparent.

Users of printing devices now demand printing of photographic quality so that they can, for example, print digital images captured from digital cameras. The desire for photographic quality, full-color images has forced conventional, colorant-transfer printing technologies to evolve to their limits. Such technologies have, in some cases, proved to be less than satisfactory for photographic printing.

Direct thermal printing provides an entirely different method for forming images on an imaging material, which may be in the form of an individual sheet of a specific size, e.g., 4×6 inches or a continuous sheet. Typically, the imaging material includes a substrate, or carrier, and a plurality of color-forming layers can be arranged on one side of the substrate or one or more color-forming layers can be arranged on each side of the substrate. A direct thermal printing device includes no ink, toner, or transfer ribbon, but simply a printing head for heating the imaging sheet itself. The imaging material for use in direct thermal printing contains at least one dye or dye precursor that changes color when heated. Examples of direct thermal printing systems are disclosed in, for example, U.S. Pat. No. 6,801,233 B2 assigned to the assignee of the instant application.

Imaging materials for direct thermal printing devices that are intended to produce multicolored images may be transparent, and may include at least one color-forming layer on each surface. Each color-forming layer on one side of the substrate forms an image in at least one color, while each color-forming layer on the other side of the substrate forms an image in at least another color. Images are formed by heating each side of the imaging material with a thermal head or other heating device, which can apply heat in an imagewise pattern. The images formed on each side of the transparent substrate are viewed together from one side of the imaging material to present to the viewer a composite, multicolored image. For this reason, the images on either side of the substrate must be substantially the same size and substantially in perfect registration with each other. In conventional printing onto an opaque imaging sheet, on the other hand, there is no need for the images on two sides of the sheet to be the same size or in registration.

Several methods for printing on both surfaces of a direct thermal imaging material have been proposed. For example, U.S. Pat. No. 4,962,386 discloses a printing device with an extremely complex mechanism for rotating the substrate such that both surfaces can be exposed to a print head sequentially. In U.S. Pat. No. 6,601,952 a method is disclosed for rotating an entire recording unit to print on the second surface of an imaging material. Another method for imaging both surfaces of a direct thermal imaging material employs two print heads, one of which heats one side of the imaging material, while the other heats the opposite side. Each of these prior art methods for printing involves complex arrangements that may be high in cost or difficult to maintain.

Accordingly, there is a need for a direct thermal printer with a simplified construction that can overcome the deficiencies of the prior art printers, including achieving more accurate registration of images printed on both surfaces of a direct thermal imaging material.

BRIEF SUMMARY OF THE INVENTION

An object of the present invention is to provide a thermal printing device that is capable of heating opposite sides of a direct thermal imaging material, or member, successively in each of two separate printing passes, by independently moving a print head subassembly of the printer relative to a platen.

Another object of the present invention is to provide a substantially straight path for the imaging material through a driving nip such that the difference in transport distance of the imaging material for a given angular rotation of a driving roller in each of two separate printing passes in which opposite sides of the imaging material are heated is substantially eliminated, and the images on the two surfaces are at least substantially the same size and at least substantially in registration.

Yet another object of the present invention is to provide a substantially constant degree of wrap around the driving roller such that the difference in transport distance of the imaging member for a given angular rotation of the driving roller in each of two separate printing passes in which opposing surfaces of an imaging member are heated is substantially eliminated, and the images formed on the two surfaces are at least substantially the same size and at least substantially in registration.

Yet another object of the present invention is to provide a substantially constant strain in the imaging material as it wraps around the driving roller such that the difference in transport distance of the material for a given angular rotation of the driving roller in each of two separate printing passes in which opposing surfaces of an imaging member are heated is substantially eliminated and the images formed on the two surfaces are at least substantially the same size and at least substantially in registration.

Yet another object of the present invention is to provide a print head subassembly within a direct thermal printing device that is configured to rotate about a platen such that heating of both sides of an imaging member can be performed.

BRIEF DESCRIPTION OF THE DRAWINGS

Additional objects, features, and advantages of the present invention will become apparent from the following detailed description of the preferred embodiments of the invention in conjunction with the accompanying drawings, where like reference numerals indicate like features, in which.

DETAILED DESCRIPTION OF PREFERRED EMBODIMENTS

Figure 1:
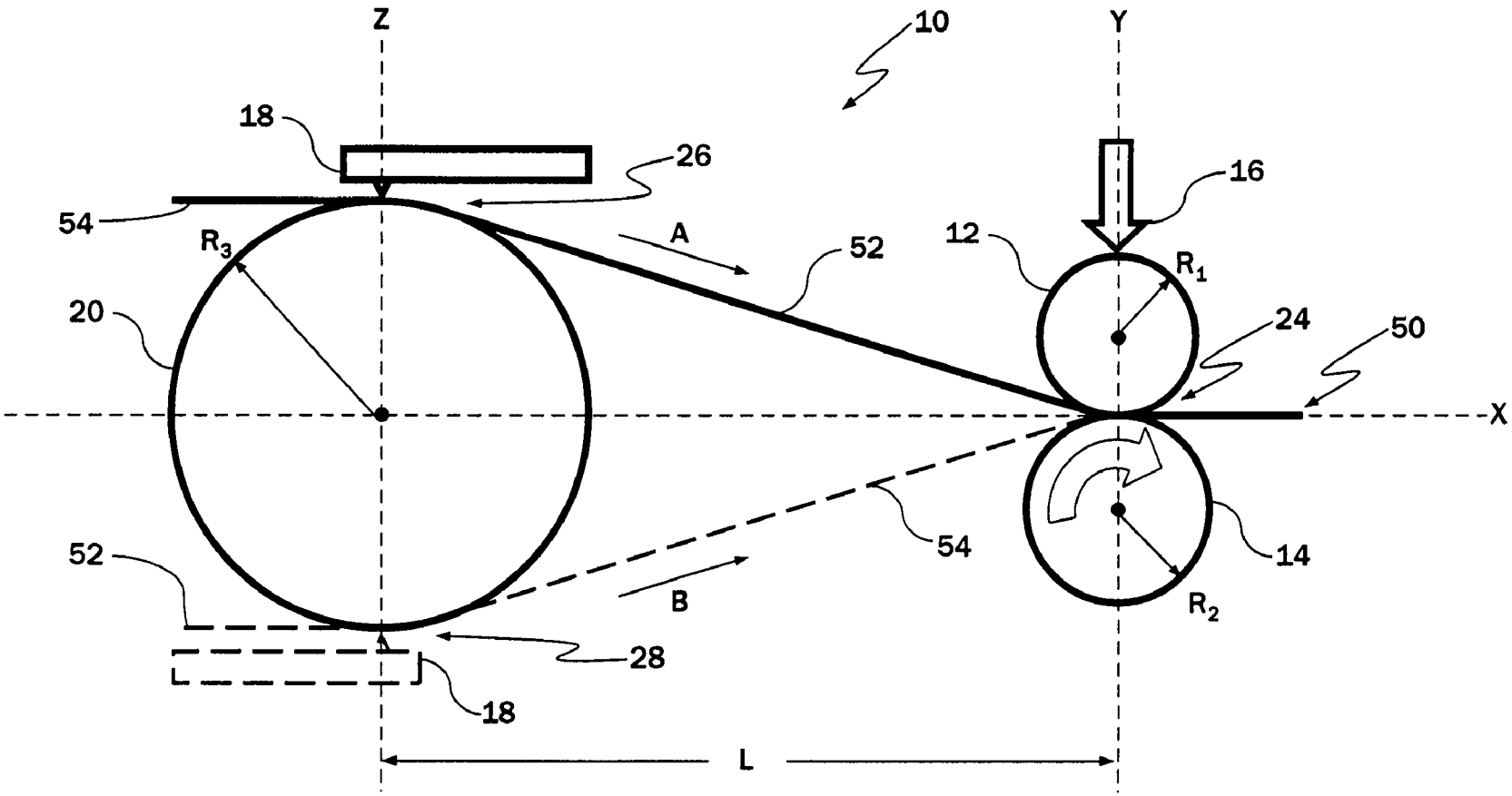
FIG. 1 is a schematic diagram of a thermal printing device with a rotating print head subassembly.

Referring now to FIG. 1 there is seen a schematic diagram of a thermal printing device 10 with a rotating print head subassembly 18 in accordance with an embodiment of the present invention. The thermal printing device 10 includes a first roller 12 and a second roller 14 for driving an imaging member 50 though the thermal printing device 10. Together, the first roller 12 and second roller 14 form a driving nip 24. At least one of the first roller 12 and second roller 14 is rotationally driven to move the imaging member 50 through the driving nip 24. The rotationally driven roller is also referred to hereinafter as the driving roller. In the embodiment shown in FIG. 1, the driving roller is roller 14 and the pressure roller 12 is biased by an optional spring 16 for ensuring that the imaging member 50 is generally in contact with both the pressure roller 12 and the driving roller 14.

Although the pressure roller 12 and the driving roller 14 are shown as single rollers, it should be understood that there may be advantages to providing a plurality of pressure and/or driving rollers instead of a single pressure or driving roller. Additionally, in some embodiments, the pressure roller 12 and driving roller 14 may extend from one edge of the imaging member 50 to the other, although this is not required. For example, in one embodiment, the driving roller 14 could be a single roller that extends across the imaging member 50 and the pressure roller 12 could be a plurality of rollers on a single shaft which would create a plurality of driving nips 24. In other, more general embodiments, the rollers described above may be any suitable device for driving the imaging member. In such a case any type of driving and pressure elements may be used including rollers, belts and the like.

The imaging sheet 50 may be any type of thermal imaging material. In the embodiment shown in FIG. 1, the imaging member includes a transparent substrate carrying at least one color-forming layer on a top surface 52 and at least one color-forming layer on a bottom surface 54 of the member. Further, it may be preferred in some embodiments to have two color-forming layers on one of the surfaces of the imaging member 50 such that a full color image may be obtained. Specifically, for the purpose of discussion, imaging member 50 may have yellow and magenta color-forming layers on surface 52 and a cyan color-forming layer on surface 54 of a transparent substrate. In this manner, it is possible to create, on imaging member 50, a full color image.

The printing device 10 also includes a platen 20 for supporting the imaging member 50 while a print head subassembly 18 is engaging the imaging member 50. Although platen 20 is shown as a roller it should be understood that it may be provided in other configurations such as a non-rotating element as is described in detail hereinafter. The print head subassembly 18 includes a print head and may, in some embodiments, also include additional elements necessary for printing on imaging materials. For example, the print head subassembly 18 may also include a controller, a heat dissipation device, etc. As shown in FIG. 1, the imaging member 50 may take one of two paths, either path A or path B. Specifically, the imaging member 50 may initially take path A and means, such as an additional roller or deflector, may be provided for guiding the member 50 in the direction indicated by A. Once the member 50 is engaged by the nip 26 formed by the platen 20 and the print head subassembly 18 located in the first, or upper, position, the print head subassembly 18, based on received information, can process the yellow and magenta color-forming layers located on surface 52 of the member, preferably in a single pass. Once that is complete, the print head subassembly 18 is rotated to a second position, shown under the platen 20, in FIG. 1. The imaging member 50 is then guided via path B through a nip 28 formed by the platen 20 and the print head subassembly 18 at the bottom of the platen 20. As can be seen from FIG. 1, when the imaging member 50 is in this position, the print head subassembly 18 can now process surface 54 of the imaging member 50 that contains the cyan color-forming layer.

In the embodiment shown in FIG. 1, the imaging sheet 50 is guided past the pressure roller 12 and driving roller 14 in the direction shown by arrows A and B (i.e., it is pulled away from the nips 26, 28) during the printing operation. However, as would be understood by a person skilled in the art, the imaging member can also be transported by means other than those illustrated.

As seen in FIG. 1, a rotational axis of the platen 20 is aligned with the driving nip 24 formed by pressure roller 12 and driving roller 14 (indicated by X) to produce a symmetric geometry between the first path A and the second path B. Additionally, as shown in FIG. 1 (and also in subsequent FIGS.) a substantially vertical axis Z that passes through the rotational axis of the platen, and a substantially vertical axis Y that passes through the rotational axes of the pressure roller 12 and driving roller 14 are both substantially perpendicular to axis X. Such symmetry may be beneficial in particular embodiments of the present invention, but is not required and is illustrated for the purpose of discussion.

In the embodiment of FIG. 1, since only the print head subassembly 18 is rotated around the platen 20 to one of the two positions, as shown, the number of moving parts is decreased from, for example, rotating both the print head subassembly 18 and platen 20 as is done in some other conventional printing devices. Additionally, since the imaging member does not have to be inverted during the imaging process and a print head on either side is not required, the complexity of the printing device is decreased as compared to some conventional printing devices. As would be understood by a person of ordinary skill in the art, the thermal printing arrangement 10 shown in FIG. 1 can be used to make a compact device.

In some embodiments, the print head subassembly 18 may be rotated by 180 degrees and in general, the rotation of the print head subassembly 18 is greater than 90 degrees. Even more generally, the print head subassembly 18 is moved from a first to a second position.

Although the arrangement of FIG. 1 may be appropriate for many applications, there may be situations where certain modifications may be desirable to further improve the printing device 10. For example, the imaging member 50 may comprise several layers, and may have a particular thickness. The thickness of the member may contribute to the misregistration of information printed in the color-forming layers located on surface 52 with information printed on the color-forming layer located on surface 54 of the member 50. Such a misregistration may cause distortion of an image that would otherwise be of photographic quality.

Figure 2:
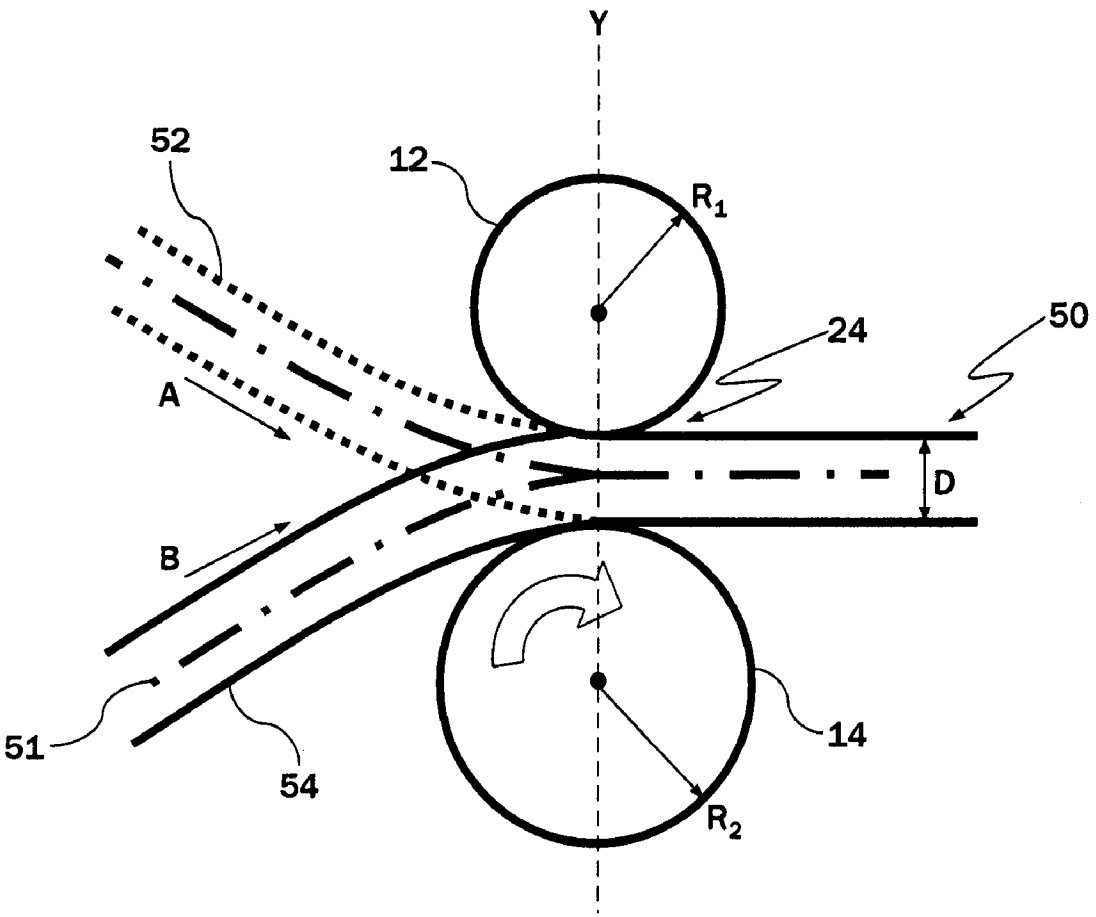
FIG. 2 is a schematic diagram of imaging material paths that are concave and convex with respect to a driving roller.

FIG. 2 is a schematic diagram illustrating how the feeding of a sheet of an imaging material may vary depending on the feeding path of the member 50 because of deviations from ideal behavior caused by the thickness of the member 50. In FIG. 2, the imaging member 50 is illustrated with pressure roller 12 and driving roller 14. As described in FIG. 1, the imaging member 50 takes path A (the convex path relative to driving roller 14 to image the color-forming layers on surface 52 and path B (the concave path relative to the driving roller 14) to image the color-forming layers on surface 54. The imaging member 50 shown in FIG. 2 has a thickness D that, as described above, may not be negligible from the perspective of structural mechanics. As can be seen from FIG. 2, when the imaging member 50 is traveling in path B, the degree of wrap around the driving roller 14 that is driving the imaging member 50 is greater than the degree of wrap around the driving roller 14 when the member 50 is traveling in path A. Additionally, as would be understood by a person of ordinary skill in the art, when the imaging member 50 bends as it does in FIG. 2 when passing through the driving nip 24, the imaging member 50 is in compression on one surface and in tension on the other surface.

Specifically, if the member 50 is bent in the direction of path B, surface 54 of the member 50 is under a compression force and surface 52 is under a tension force. When the imaging member 50 is bent in the direction of path A, the surface 54 is under tension and the surface 52 is under compression. As would be understood by a person skilled in the art, the surface that is under compression is shortened in comparison to the neutral axis 51 of the imaging member (for a symmetric structure, the neutral axis is its centerline, and in general the neutral axis is the axis that experiences no longitudinal stress when the imaging member is bent), and the surface that is under tension is lengthened in comparison to this neutral axis. The imaging member is sent through the driving nip 24 by a rotation of the driving roller. For a given angular rotation of the driving roller 14, the surface 54 of the imaging member 50 in contact with the drive roller is propelled a predetermined linear distance, but the neutral axis of the member moves a distance that may be less than or greater than this predetermined distance, depending upon whether the driven surface is under tension or compression. When the surface 54 of imaging member 50 is under compression, and therefore has negative strain, the distance the neutral axis 51 is advanced is greater than the predetermined linear distance. The neutral axis 51 of the imaging member 50 is advanced less than the predetermined linear distance when surface 54 is under tension and has positive strain. Because the advancement of the neutral axis of the imaging member is not, the same for path A and path B, a misregistration of image information printed on the two sides 52, 54 of the imaging member 50 can occur. The overall lengths of the images printed in paths A and B are not necessarily the same in this case.

As described above, the distance that the neutral axis of imaging member 50 is moved for a given angular rotation of the driving roller is variable depending upon which of the two paths the imaging member follows. For example, given the typical dimensions of the elements shown in FIG. 1 such as the radius $R_1$ of the driving roller 14, and assuming a paper thickness D of 0.175 mm, the difference in motion of the neutral axis of the imaging member can be calculated as $D/R_1$. The amount of error in image length, and therefore registration, can be substantial.

The difference in motion of the imaging member 50 for path A and path B is theoretically predictable if the member wraps perfectly around the rollers for both passes, so it can be thought that the difference could be calculated and the printing of print head subassembly 18 adjusted accordingly. Unfortunately, perfect wrap around the rollers is typically not achieved in actual practice.

Figure 3:
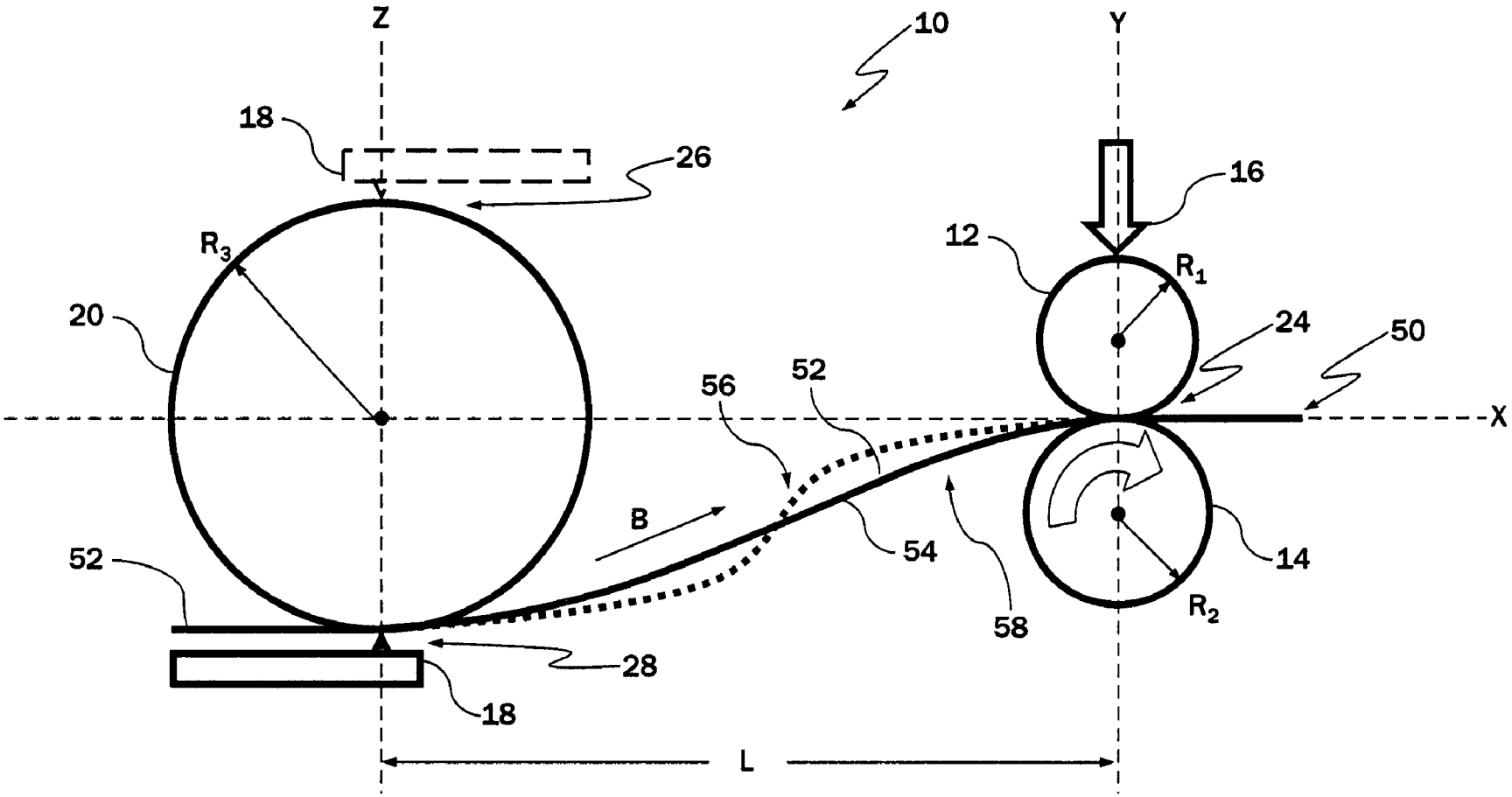
FIG. 3 is a schematic diagram of a thermal printing device carrying an imaging material at a first tension and at a second, lower tension.

As shown in FIG. 3 the imaging member 50 may take several paths between the print head subassembly 18 and the driving nip 24 formed by pressure roller 12 and driving roller 14 depending on the tension in the imaging material. FIG. 3 illustrates two specific types of paths that the imaging member 50 may take, a first path 56 and a second path 58. When the tension is higher, the imaging member 50 is more likely to follow path 58 and when the tension is lower, the member is more likely to follow path 56. These varying paths affect the wrap around the driving roller (the driving roller 14 in this case) and therefore may not allow for accurate compensation for the difference in the transport distance of the imaging member in paths A and B of FIG. 2 for given angular rotation of the driving roller 14.

When the imaging member 50 is under higher tension, the length of the imaging member between printing nip 28 and driving nip 24 is shorter and therefore a tighter conformance occurs around the driving roller 14. Since tighter conformance causes more compressive strain in surface 54 of the imaging member 50, the neutral axis of the member is driven further through the driving nip 24 by a given angular rotation of the driving roller 14 than when the imaging member 50 is under a lower tension.

As mentioned above, the tension in the imaging member between the nip 28 formed by the print head subassembly 18 and platen 20 and the driving nip 24 affects the wrap of the member around driving roller 14. The magnitude of the tension in the member depends upon the frictional force developed between the print head subassembly 18 and the member 50, and this depends upon the force applied to the print head subassembly 18 against platen 20, and the coefficient of friction between the print head and the member 50 (neglecting, for the sake of simplicity, other effects such as the rotational friction of the platen roller). The coefficient of friction between the print head subassembly 18 and imaging member 50 is itself variable, and one factor that may influence this coefficient of friction is the heat that has to be applied to form the image. Since the physical properties of the surfaces of typical thermal imaging materials are commonly temperature-dependent, it will be readily understood that the heat generated by the print head subassembly 18 while printing imaging member 50 may cause the coefficient of friction between the print head subassembly 18 and imaging member 50 to be variable. It is very difficult to predict what the coefficient of friction between the print head subassembly 18 and the imaging member 50 will be, since it is likely to be dependent in a complex manner upon the image being printed. Since this coefficient of friction is unpredictable, the tension in the imaging member is unknown, and the degree of wrap of the imaging member around the drive roller is likewise unknown. Consequently the distance that the neutral axis of the imaging member is driven for a given angular rotation of the driving roller is also unpredictable. Accordingly, it is very difficult to provide a control mechanism to compensate for the image misregistration caused by the differential feeding distance of the medium by the driving roller in each of the printing passes.

Figure 4:
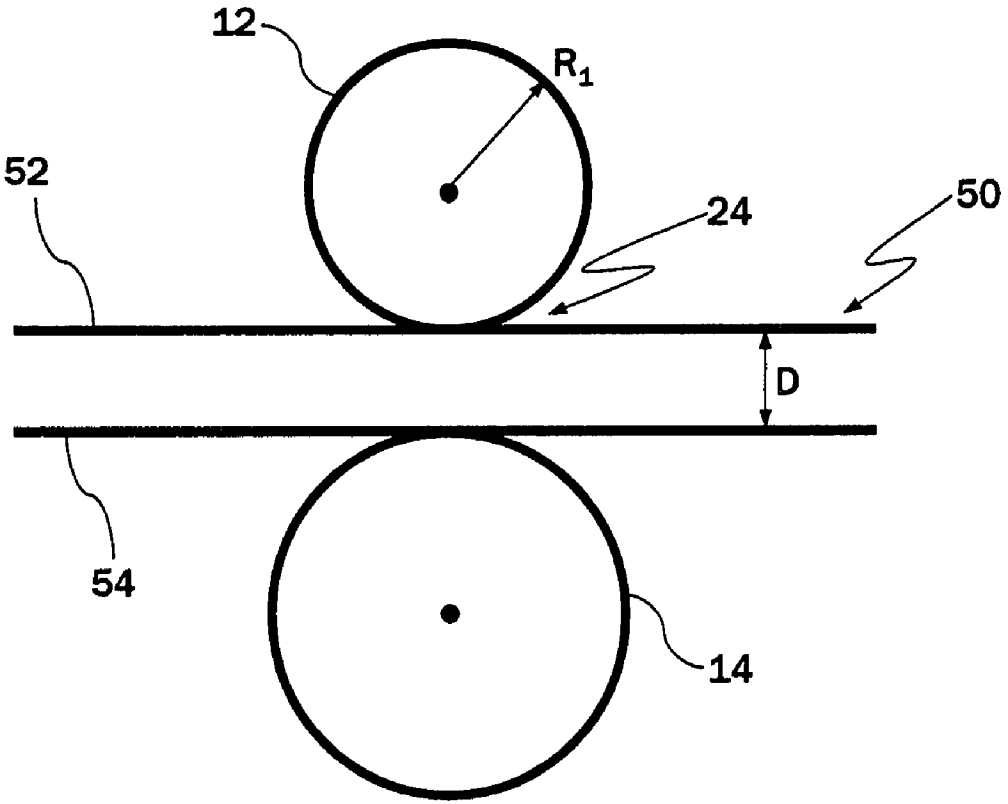
FIG. 4 is a schematic diagram of a straight imaging material path.

FIG. 4 is a schematic diagram of an imaging member 50 in a substantially straight path through the driving nip 24 that eliminates the differences in feeding distance of imaging member 50 for a given angular rotation of the driving roller. It will be appreciated that when imaging member 50 is sent through the pressure roller 12 and driving roller 14 in a substantially straight path, there is no substantial difference between the distance of transport of imaging member 50 during the formation of an image on surface 52 or on surface 54. Additionally, any non-zero amount of tension is enough to keep the imaging member substantially straight. Therefore, the motion of imaging member 50 is essentially independent of the coefficient of friction between print head subassembly 18 and imaging member 50. In certain embodiments of the present invention, especially when a very high-precision thermal image is desired, it may be beneficial to provide the imaging member 50 with a substantially straight path as it enters the nip 24, in such a way that the imaging member 50 is substantially perpendicular to the plane passing through the axis of the pressure roller 12 and the axis of the driving roller 14 as it enters the nip 24.

Figure 5A:
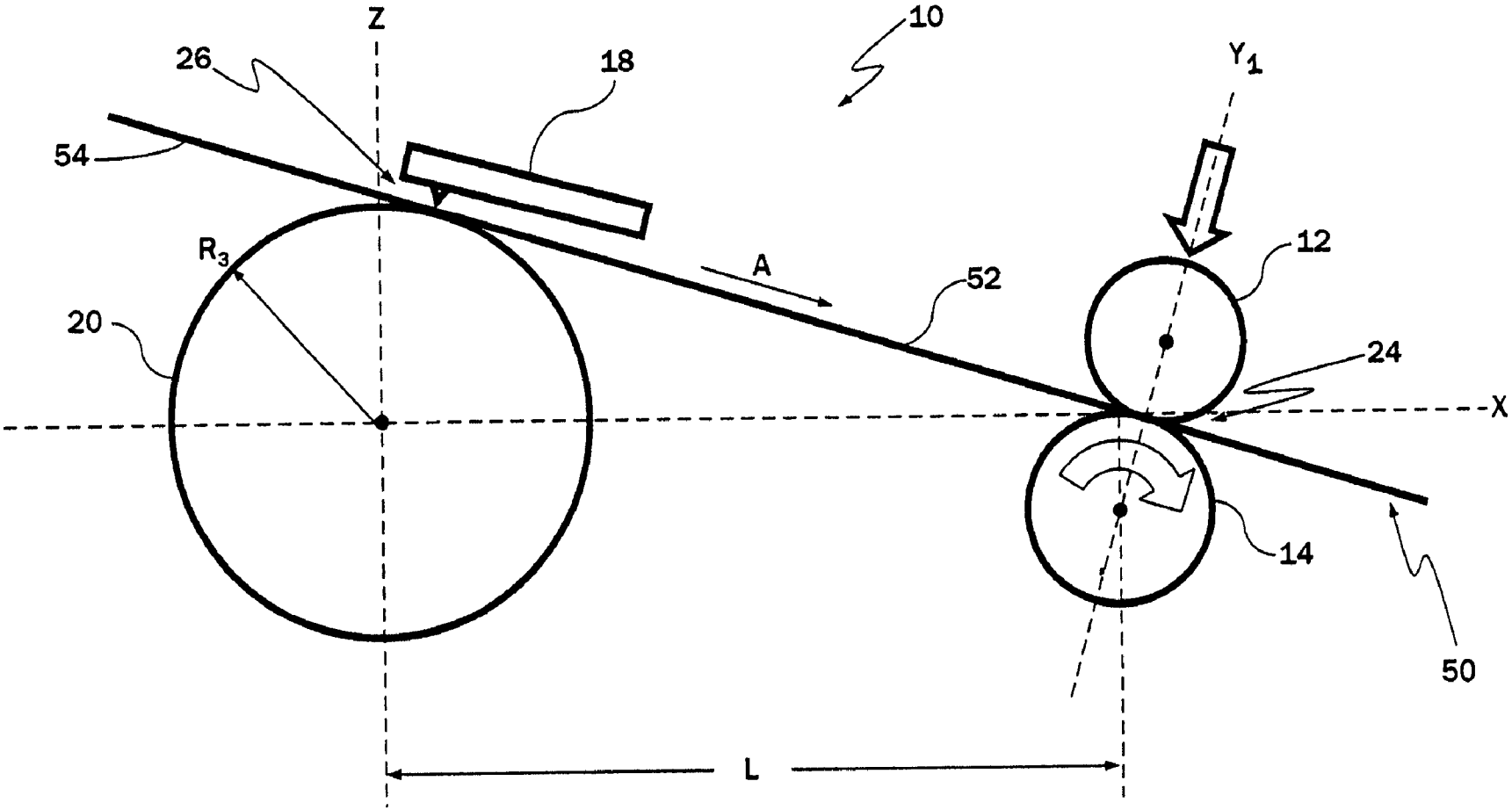
FIGS. 5A, 5B, and 5C are schematic-diagrams of a configuration of a thermal printing device with a substantially straight path for the imaging material through the driving nip in accordance with an embodiment of the present invention.
Figure 5B:
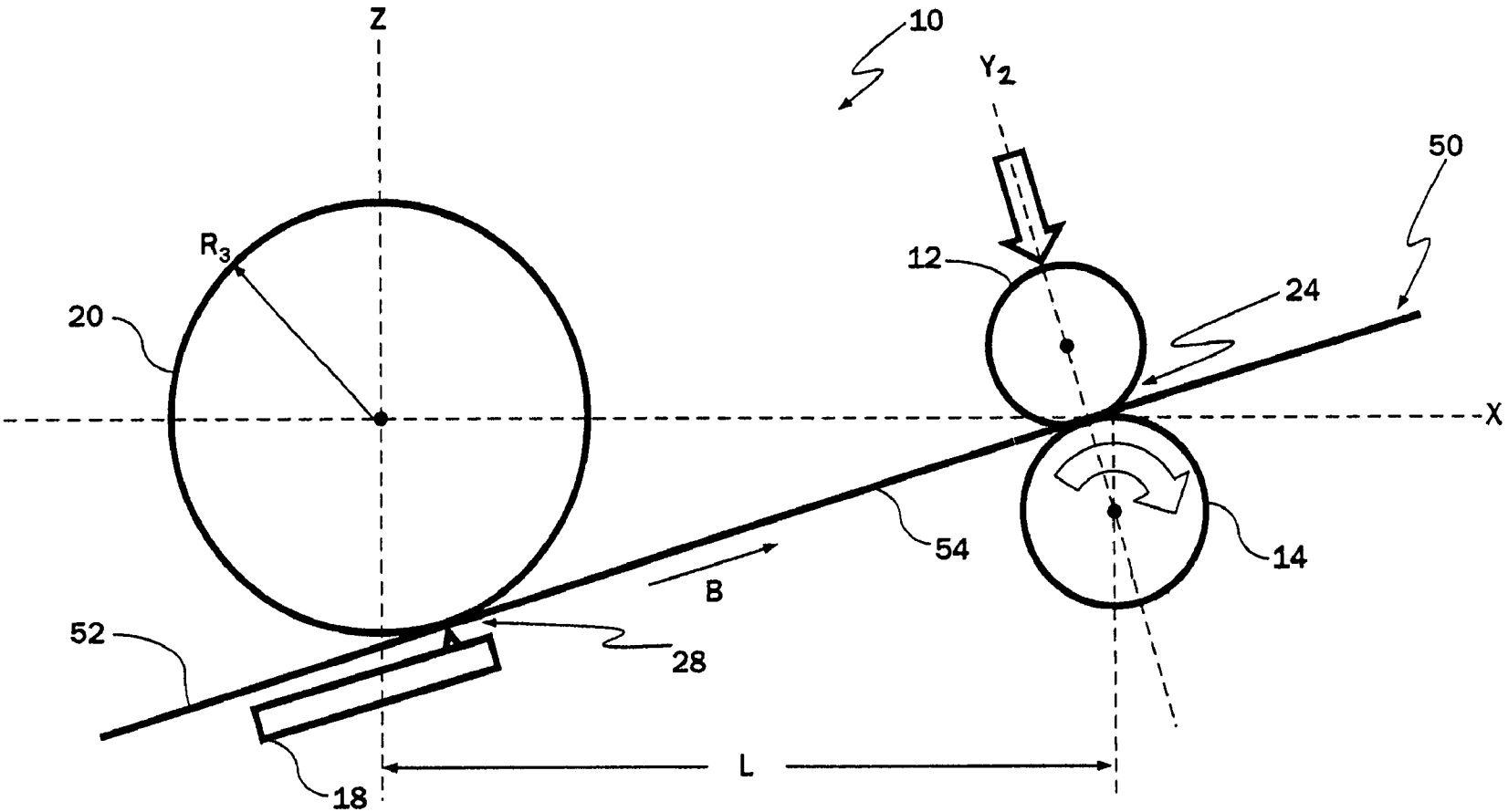
Figure 5C:
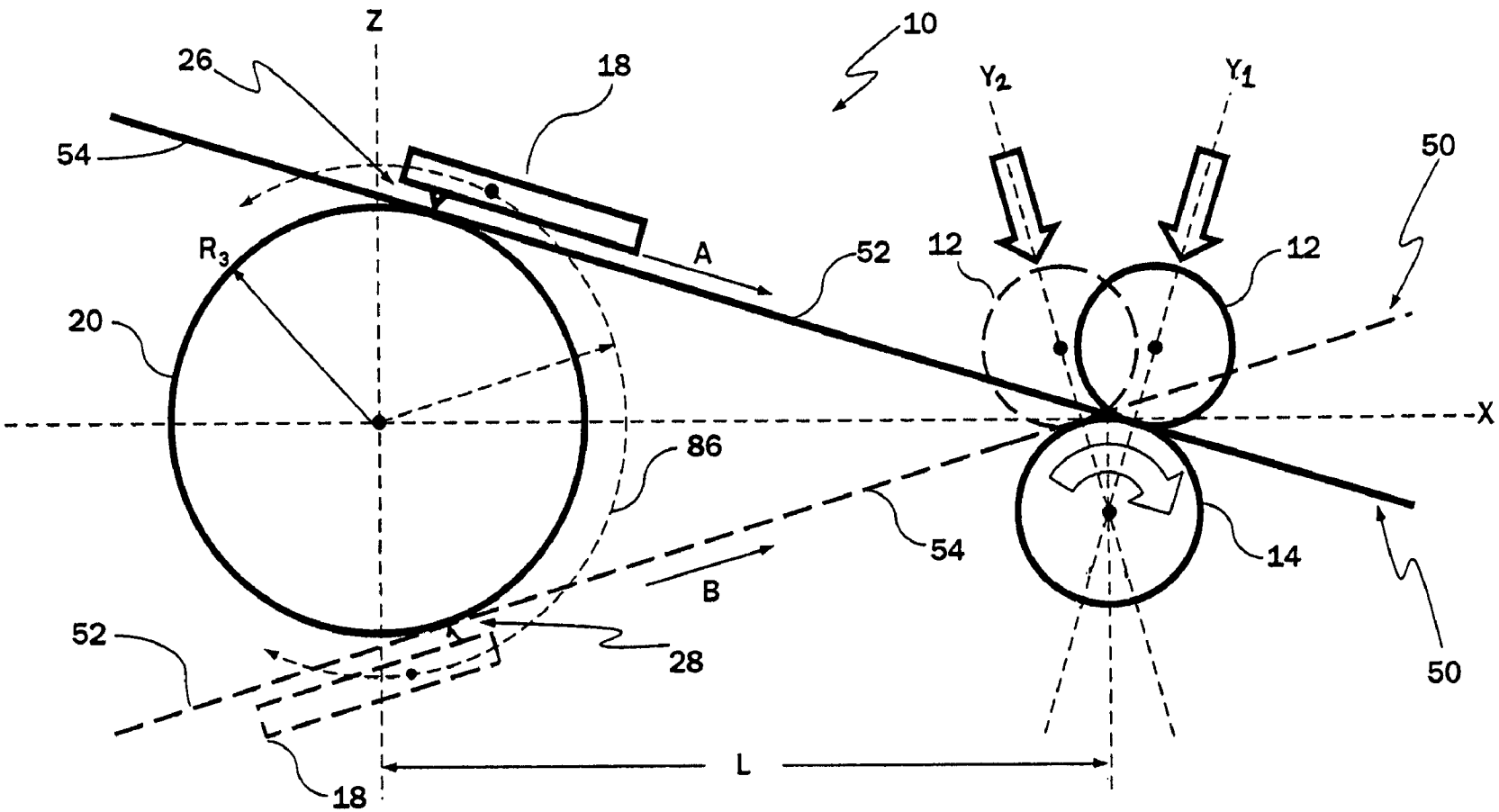

FIGS. 5A, 5B, and 5C are schematic diagrams of a configuration of a thermal printing device 10 with a substantially straight path for the imaging member through the driving nip 24 in accordance with an embodiment of the present invention. As can be seen from this embodiment, the printing device 10 includes a pressure roller 12, a driving roller 14, a platen 20 and a print head subassembly 18 which are substantially similar to the devices described with respect to FIG. 1 above. The imaging member 50 shown in FIG. 5A is fed along paper path A to activate the color-forming layer on surface 52 and (as shown in FIG. 5B) the imaging member 50 is fed along path B to activate the color-forming layer on surface 54. As might be best seen from FIG. 5C, which shows the configuration of the printing device 10 for activating both surfaces 52 and 54, the pressure roller 12 rotates slightly around the driving roller (either to axis $Y_1$ or axis $Y_2$) depending on which path (A or B) the imaging member 50 is taking. With this rotation, the imaging member 50 is not wrapping substantially around either of the rollers 12 or 14 and is traveling in a substantially straight path through the driving nip 24 for both paths A and B, thereby eliminating the tension-dependent change in member transport distance with respect to driving roller rotation.

Figure 6:
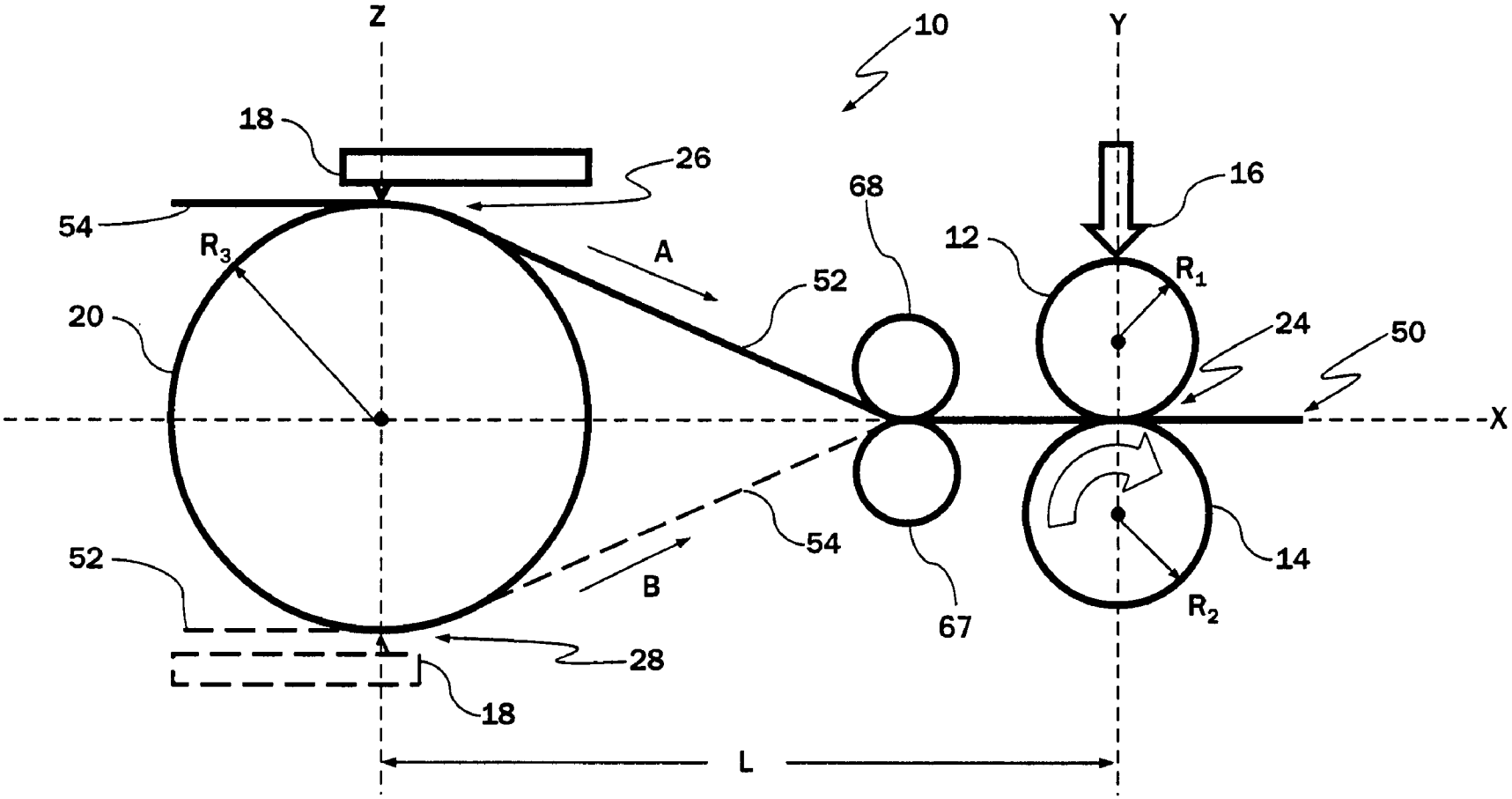
FIG. 6 is a schematic diagram of a configuration of a thermal printing device with a substantially straight path for the imaging material through the driving nip in accordance with another embodiment of the present invention.

FIG. 6 is a schematic diagram of a thermal printing device 10 with a substantially straight path for the imaging member through driving nip 24 in accordance with another embodiment of the present invention. The printing device 10 in FIG. 6 is substantially similar to the printing device 10 described in FIG. 1. However, in FIG. 6, a guiding mechanism, in this embodiment a pair of guide rollers 67 and 68, is added in the path between the platen 20 and driving nip 24. The guide rollers 67 and 68 guide the imaging member 50 into a path that is substantially perpendicular to the plane passing through the axes of the driving roller and pressure roller, such that the imaging member 50 travels through the driving nip 24 in a substantially straight path.

As shown in FIG. 6 the media path between the guide rollers and the drive roller is straight. In practice, the stiffness of the imaging member may result in a curvature of this path between the guide rollers and nip 24. This curvature will be upward for path A and downward for path B and may contribute a residual misregistration in printing. To compensate for this effect the spacing between the guide rollers 67 and 68 may be adjusted vertically to ensure that the imaging member enters the nip 24 parallel to axis X.

As would be understood by a person skilled in the art, any device can be placed in the path of the imaging member 50 to alter the path of the imaging member 50 such that the imaging member 50 can travel through the driving nip 24 in a substantially straight path, thereby substantially eliminating the variations in transport distance of the imaging member with respect to driving roller rotation.

Figure 7:
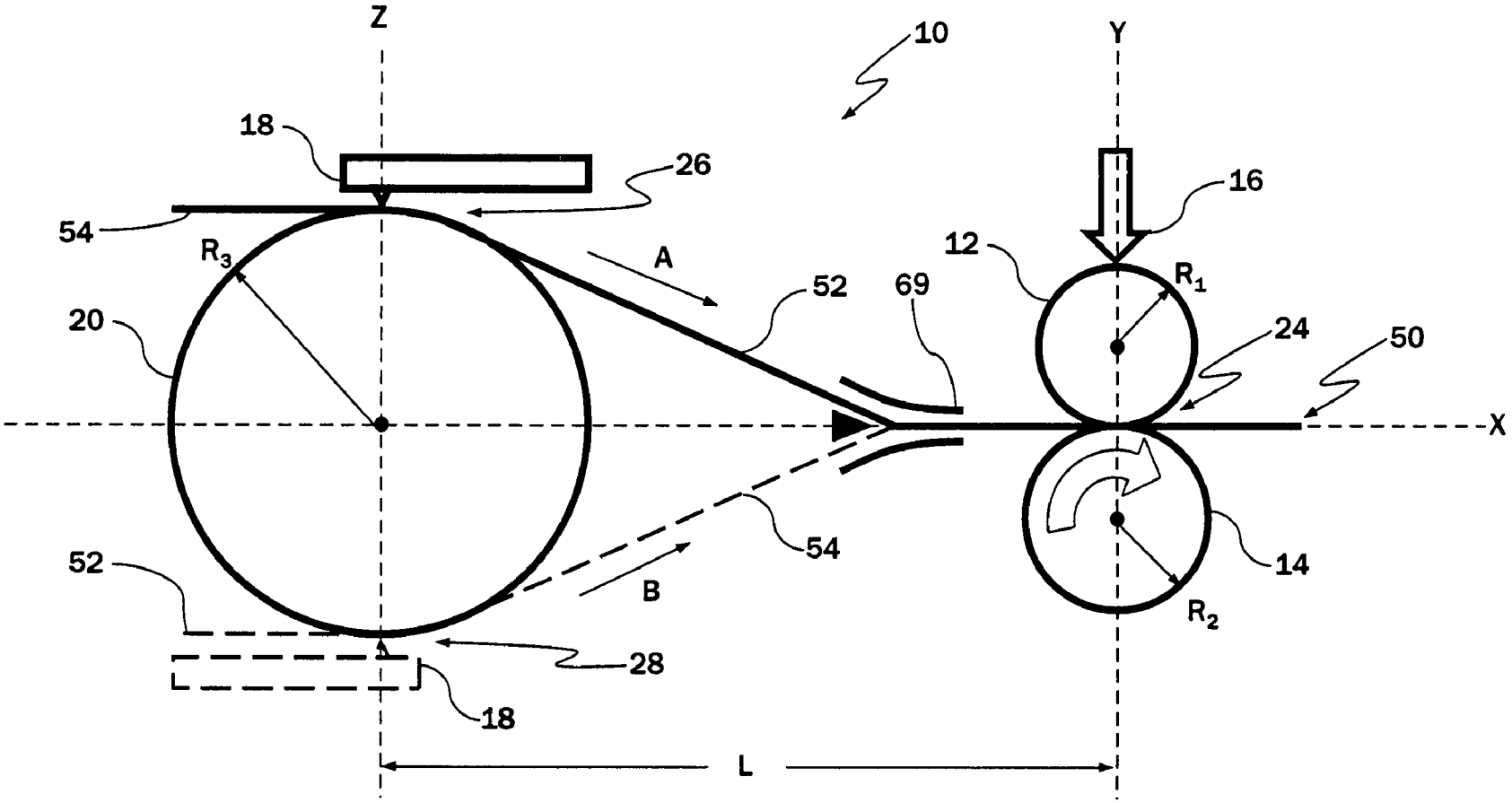
FIG. 7 is a schematic diagram of a configuration of a thermal printing device with a substantially straight path for the imaging material through the driving nip in accordance with another embodiment of the present invention.

FIG. 7 is a schematic diagram of a configuration of a thermal printing device 10 with a substantially straight path for the imaging member through the, driving nip 24 in accordance with another embodiment of the present invention. FIG. 7 illustrates another embodiment of a guide mechanism for the imaging member. In this embodiment, the guide mechanism is comprised of guide channels 69 for directing the imaging member 50 into the A path or the B path.

Figure 8:
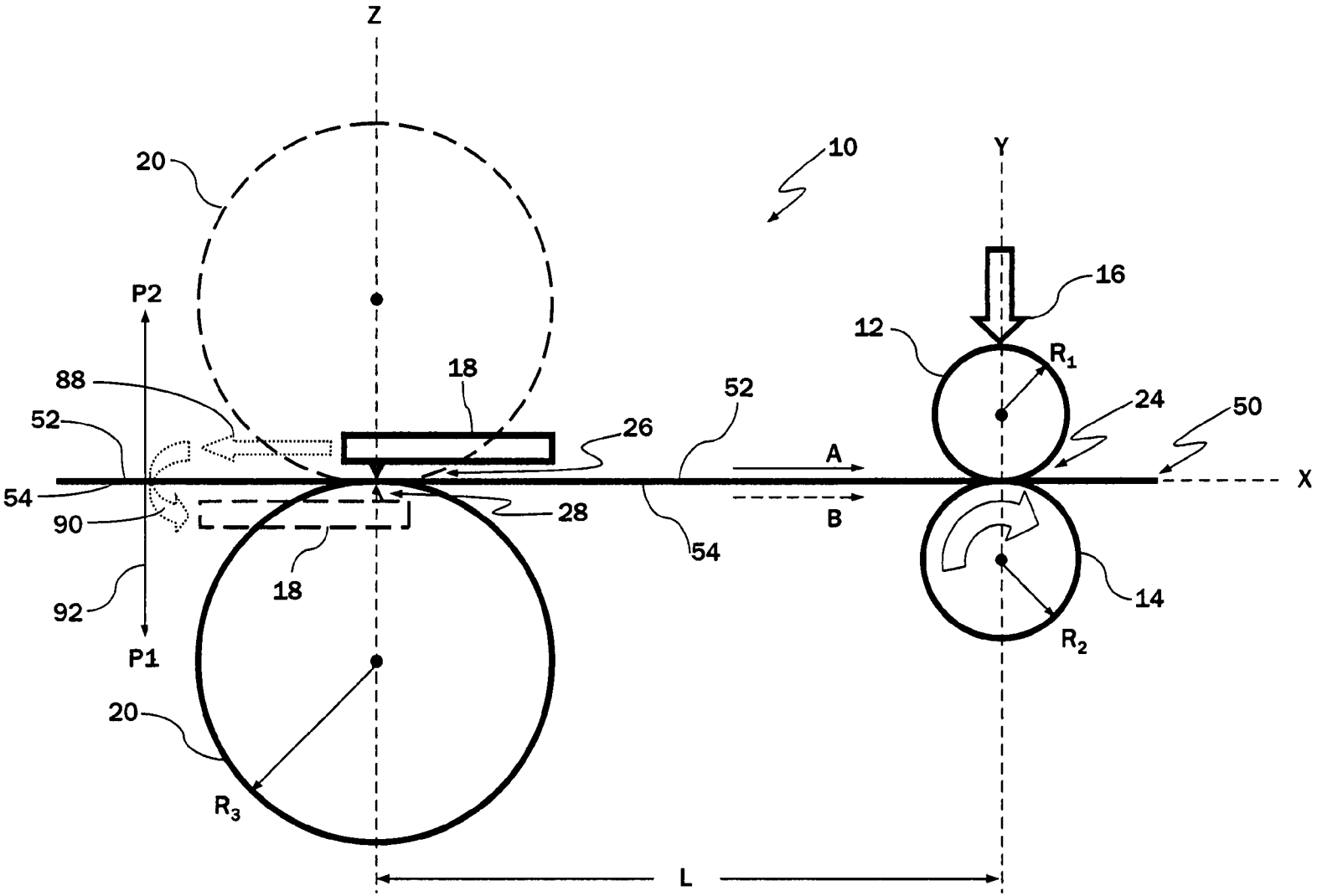
FIG. 8 is a schematic diagram of a configuration of a thermal printing device with a substantially straight path for the imaging material through the driving nip in accordance with another embodiment of the present invention.

FIG. 8 is a schematic diagram of a configuration of a thermal printing device 10 with a substantially straight path for the imaging member through the driving nip 24 in accordance with another embodiment of the present invention. The printing device shown in FIG. 8 is similar to the printing device 10 described in FIG. 1. However, the embodiment shown in FIG. 8 provides a substantially straight path for the imaging member (i.e., a path that is perpendicular to the plane Y passing through the axes of the driving roller and pressure roller) as it enters the driving nip. As illustrated, paths A and B in this embodiment are substantially identical. This is achieved by including a movable platen 20. A single platen roller that is movable into two different positions on either side of axis X is shown in FIG. 8. Alternatively, two different platens on either side of axis X may be used. In a first path, the platen 20 is located at position P1 and the print head subassembly 18 is located above the platen 20 such that the printing nip 26 and the driving nip 24 lie in a plane perpendicular to plane Y. To print on the second surface 54 of the imaging member 50, the print head subassembly 18 moves out of the path of the platen 20 as indicated by arrow 88. The platen 20 moves to position P2 and the print head subassembly 18 rotates as shown by arrow 90 to form a printing nip 28 that is in a substantially identical location as printing nip 26. As would be understood, the print head subassembly 18 may be configured on a guide system or alternatively, the print head subassembly 18 may also be configured to rotate around the platen 20. The rotation of the print head subassembly 18 may be as described above with the fixed platen 20 (see, for example, FIG. 6). More broadly, the print head subassembly 18 can be moved by any known means. This embodiment helps ensure that the imaging member 50 is substantially perpendicular to plane Y in both printing paths.

FIGS. 9-13 illustrate additional embodiments of the present invention. The embodiments illustrated in FIGS. 5-8 are intended to eliminate wrap of the imaging member 50 around the driving roller 14 since, as discussed above, a varying wrap and varying degrees of compression and tension of the surface of the imaging member being driven adversely affected image registration. The straight path through driving nip 24 achieved by the embodiments of FIGS. 5-8 is a specific instance of the more general solution of providing identical wrap, but not necessarily zero wrap, around the driving roller for all paths of the imaging member. If the wrap around the driving roller is held constant, there is no change in transport distance of the imaging member for a given angular rotation of the driving roller accompanying a change in the path of imaging member 50 and therefore no substantial misregistration. Additionally, and even more generally, constant wrap is just a particular way of achieving a constant strain in the imaging member at the driven location. Thus, in general, it is not the degree of wrap but rather the maintenance of constant strain in the imaging member at the driven location for all printing paths that reduces misregistration. FIGS. 9-13 illustrate several embodiments for maintaining a constant degree of wrap and, alternatively, a constant strain in the imaging member 50 at the driven location.

Figure 9:
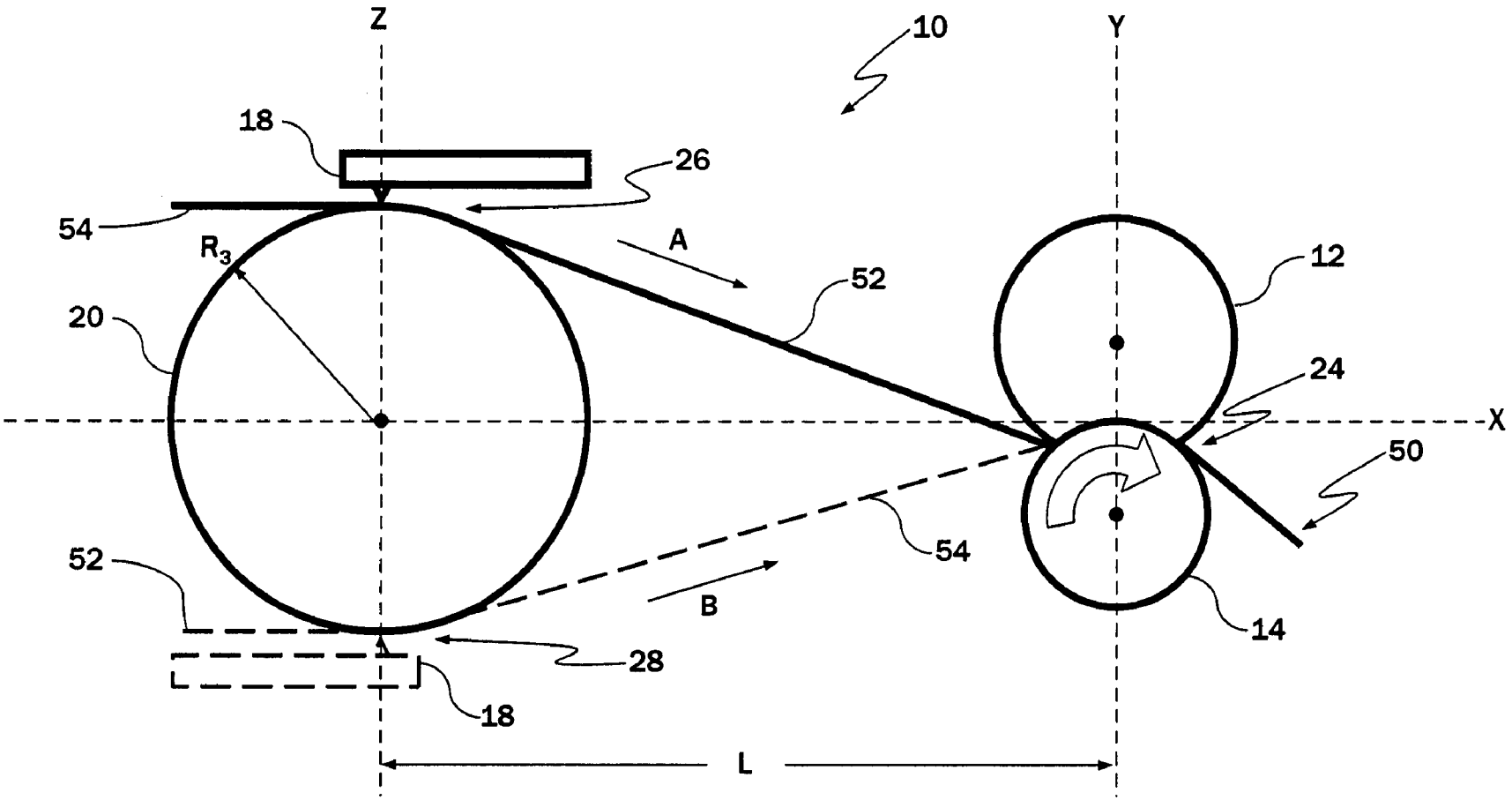
FIG. 9 is a schematic diagram of a configuration of a thermal printing device where the imaging material has a substantially constant degree of wrap around the driving roller in accordance with another embodiment of the present invention.

FIG. 9 is a schematic diagram of a configuration of a thermal printing device 10 in accordance with another embodiment of the present invention. The printing device 10 in FIG. 9 is substantially similar to the printing device 10 described in FIG. 1. However, the embodiment in FIG. 9, like the embodiments of FIGS. 5-8, substantially eliminates any difference in transport distance of the imaging member for a given angular rotation of the driving roller between path A and path B of the printing device 10. Specifically, as seen in FIG. 9, the path through the pressure roller 12 and driving roller 14 for both path A and path B is substantially constant. This is accomplished by using a pressure roller having a surface of a soft material such that it may deform (conform) around the driving roller 14. In this manner, the pressure roller is in contact with the driving roller 14 over an extended area instead of just substantially a tangent line. By allowing the pressure roller 12 to deform around the driving roller so that pressure is maintained past the imaginary line of contact of a plane tangent to both driving roller 14 and the lower half of platen 20, the path of the imaging member can be held constant through the driving nip 24 regardless of whether the imaging member follows path A or path B. Therefore, the motion of the imaging member while printing on surface 52 and surface 54 is substantially similar.

Figure 10:
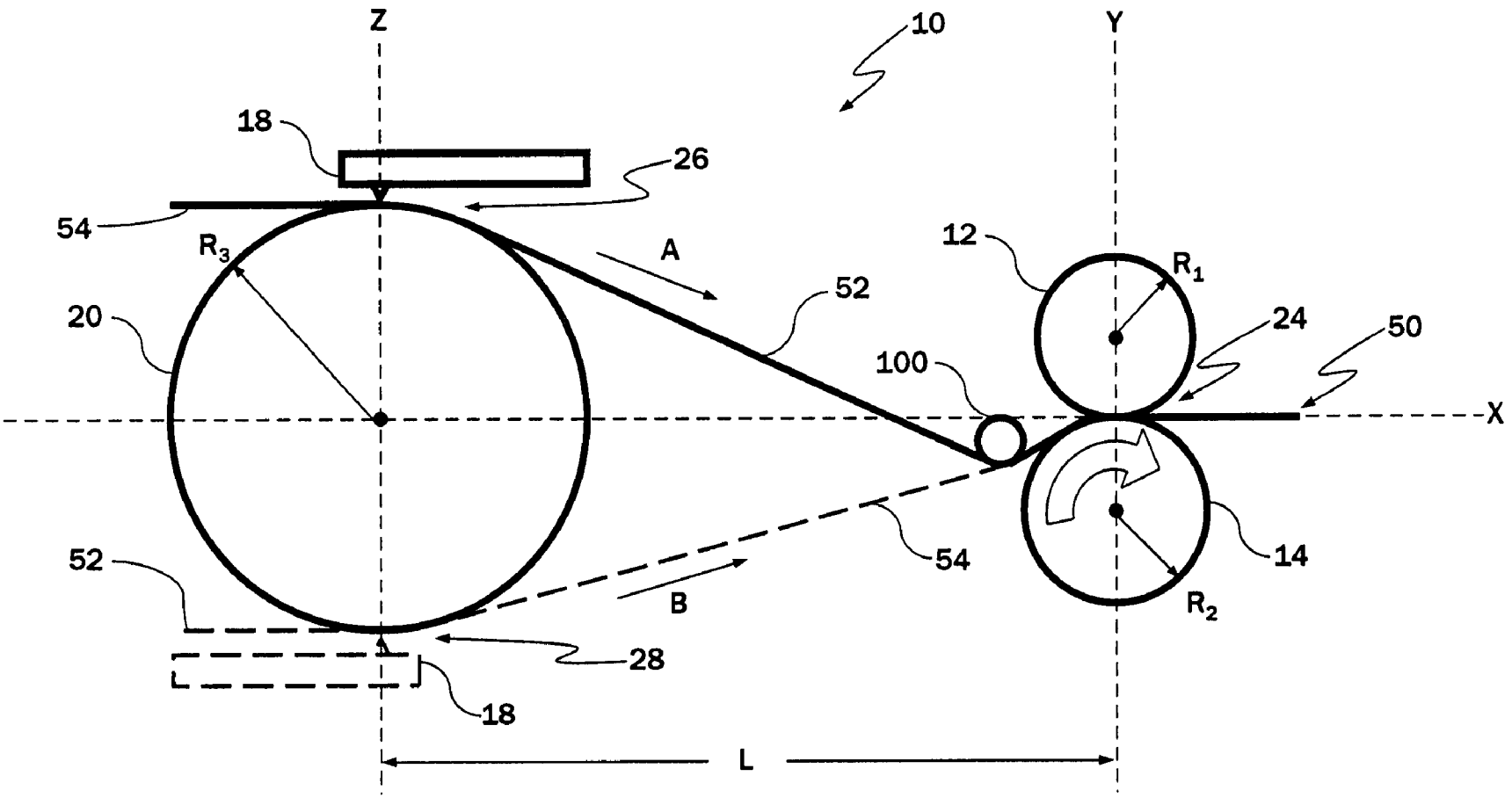
FIG. 10 is a schematic diagram of a configuration of a thermal printing device where the imaging material has a substantially constant degree of wrap around the driving roller in accordance with another embodiment of the present invention.

FIG. 10 is a schematic diagram of a configuration of a thermal printing device 10 where an imaging member has a substantially constant degree of wrap around the driving roller in accordance with another embodiment of the present invention. In FIG. 10, the thermal printing device 10 is provided with an auxiliary roller 100 between platen 20 and driving roller 14 for guiding the imaging member in paths A and B. By placing the auxiliary roller 100 such that the path of the imaging member in both paths A and B is deflected by contact with auxiliary roller 100 so as to pass at or below the plane that is tangent to both platen 20 and the lower half of driving roller 14, the wrap of the imaging member around driving roller 14 is intended to be substantially constant for both paths. In this embodiment, the imaging member 50 is in contact with the driving roller 14 over an extended area instead of just a substantially tangent line, as is illustrated in FIG. 6, for example, and the contact area is substantially identical whether the imaging member follows path A or path B. Therefore, the transport distances of the imaging member for a given angular rotation of the driving roller while printing on either surface 52 or surface 54 are substantially similar.

Figure 11:
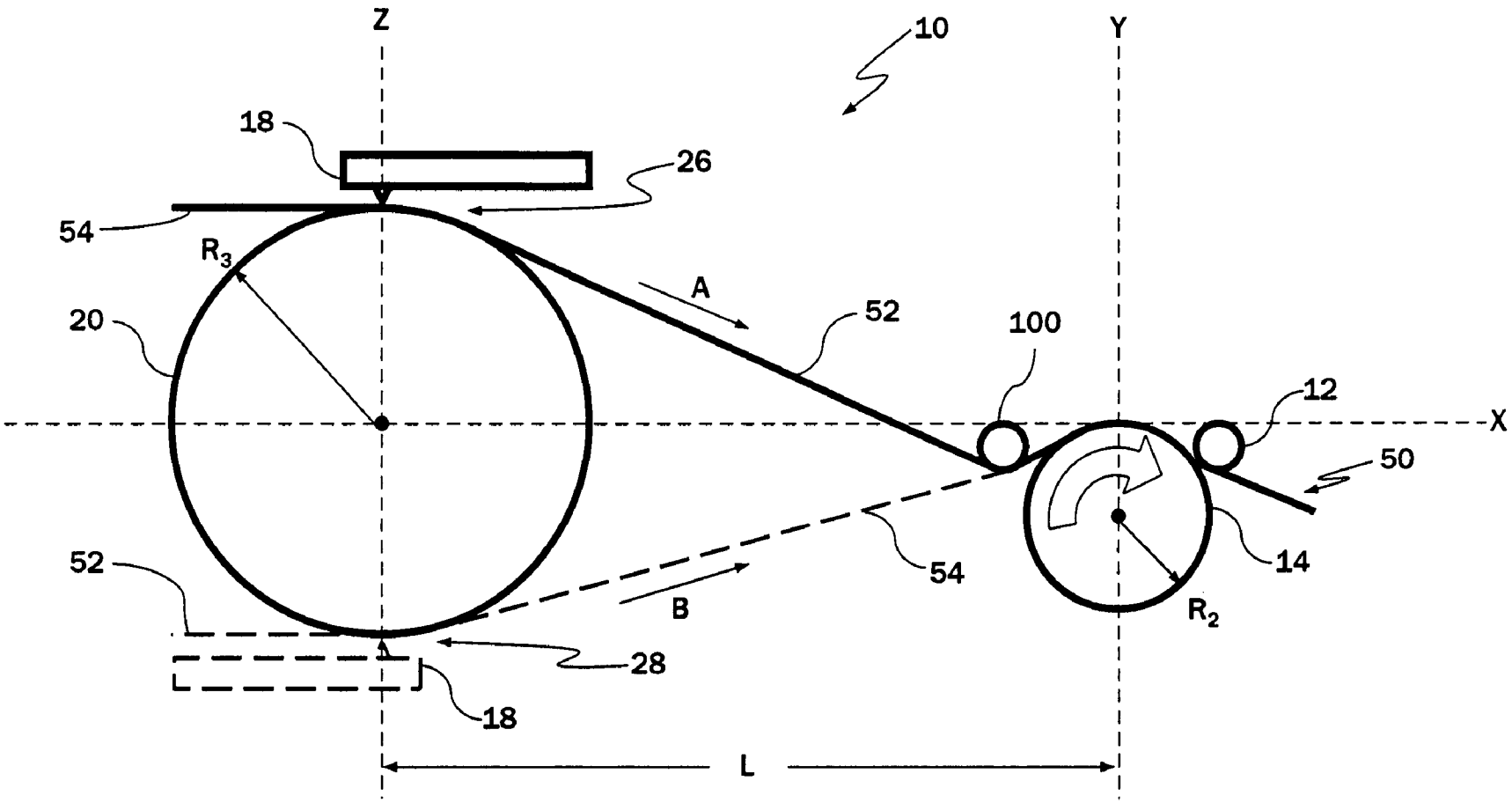
FIG. 11 is a schematic diagram of a configuration of a thermal printing device where the imaging material has a substantially constant degree of wrap around the driving roller in accordance with another embodiment of the present invention.

FIG. 11 is a schematic diagram of a configuration of a thermal printing device 10 where the imaging member has a substantially constant degree of wrap around the driving roller in accordance with another embodiment of the present invention. FIG. 11 is similar to FIG. 10 except that in FIG. 11 the rotational axis of pressure roller 12 has been rotated about the rotational axis of driving roller 14 and the size of the pressure roller 12 is shown as having been reduced. As would be understood by a person of ordinary skill in the art, the embodiment of FIG. 11 may be well suited for embodiments of a printing device 10 where space is a constraint.

Figure 12:
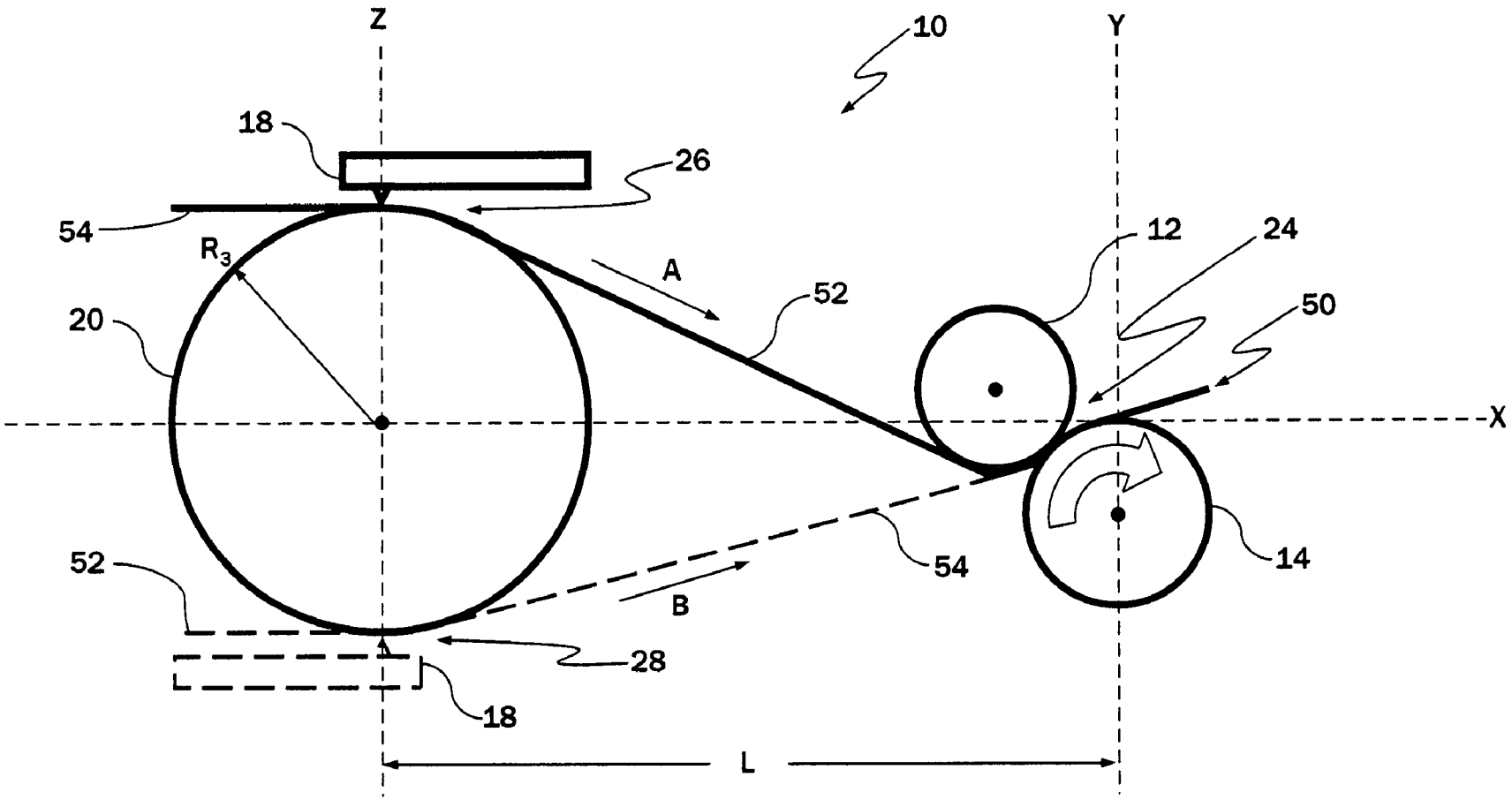
FIG. 12 is a schematic diagram of a configuration of a thermal printing device where the imaging material has a substantially constant degree of wrap around the driving roller in accordance with another embodiment of the present invention.

FIG. 12 is a schematic diagram of a configuration of a thermal printing device 10 where the imaging member has a substantially constant strain of the driven surface of the imaging member at the driving nip in accordance with another embodiment of the present invention. The printing device 10 in FIG. 12 is substantially similar to the printing device 10 described in FIG. 1. However, the embodiment in FIG. 12, like the embodiment of FIGS. 5-11, substantially eliminates any difference in the transport distance of the imaging member for a given angular rotation of the driving roller between path A and path B of the printer 10. In FIG. 12, the axis of the pressure roller, which may be a rigid member, is moved to deflect the imaging member 50 to or below a plane tangent to both the drive roller and the bottom of the platen roller. Again, as described above with reference to FIG. 9, the imaging member 50 passes through driving nip 24 in substantially the same manner in both path A and path B and therefore the strain of the driven surface of the imaging member is substantially constant. Accordingly, the motion of the imaging member is substantially the same for these two paths.

Figure 13:
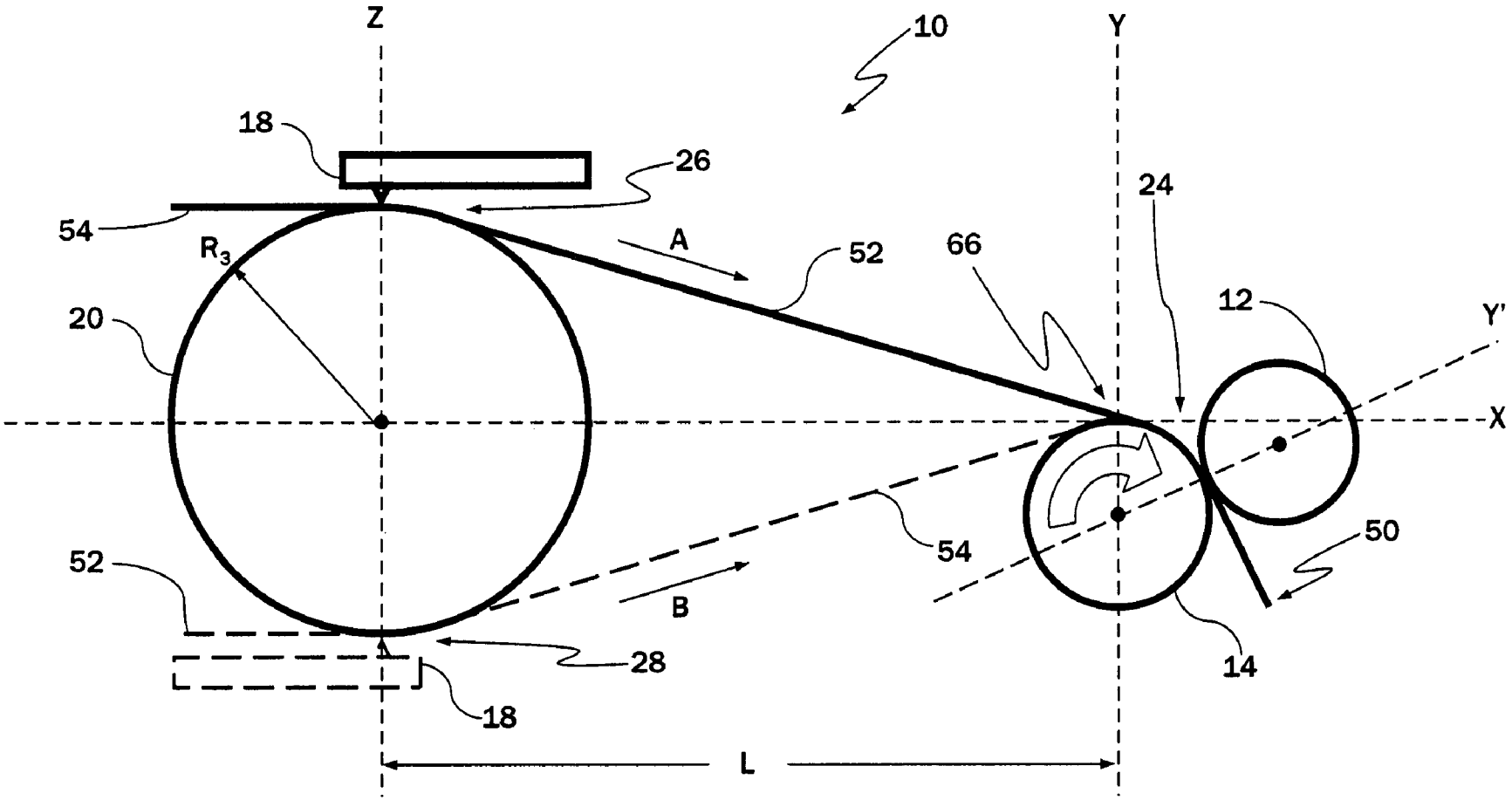
FIG. 13 is a schematic diagram of a configuration of a thermal printing device where the imaging material has a substantially constant strain around the driving roller in accordance with another embodiment of the present invention.

FIG. 13 is a schematic diagram of a configuration of a thermal printing device 10 where the imaging member has a substantially constant strain at the driven nip in accordance with another embodiment of the present invention. The printing device 10 in FIG. 13 is substantially similar to the printing device 10 described in FIG. 1. However, the embodiment in FIG. 13, like the embodiments of FIGS. 5-12, substantially eliminates any difference in transport distance of the imaging member for a given angular rotation of the driving roller between path A and path B of the printing device 10. In FIG. 13, the print nip 24 is moved past (in the opposite direction of that in FIG. 12) the line 66 along which media paths A and B come together. Again, as described above with respect to FIGS. 9 and 12, the imaging member 50 passes through driving nip 24 in substantially the same manner in both path A and path B and therefore the strain of the driven surface of imaging member 50 is substantially the same for the two paths. Accordingly, the transport distances for printing of surface 52 and surface 54 are substantially similar for a given angular rotation of the driving roller.

As mentioned above, the platen 20 of a thermal printing device may be rotating or non-rotating. Any of the above-mentioned methods for ensuring that the transport distances for printing the surfaces 52 and 54 of imaging member 50 are substantially similar may be used.

Figure 14:
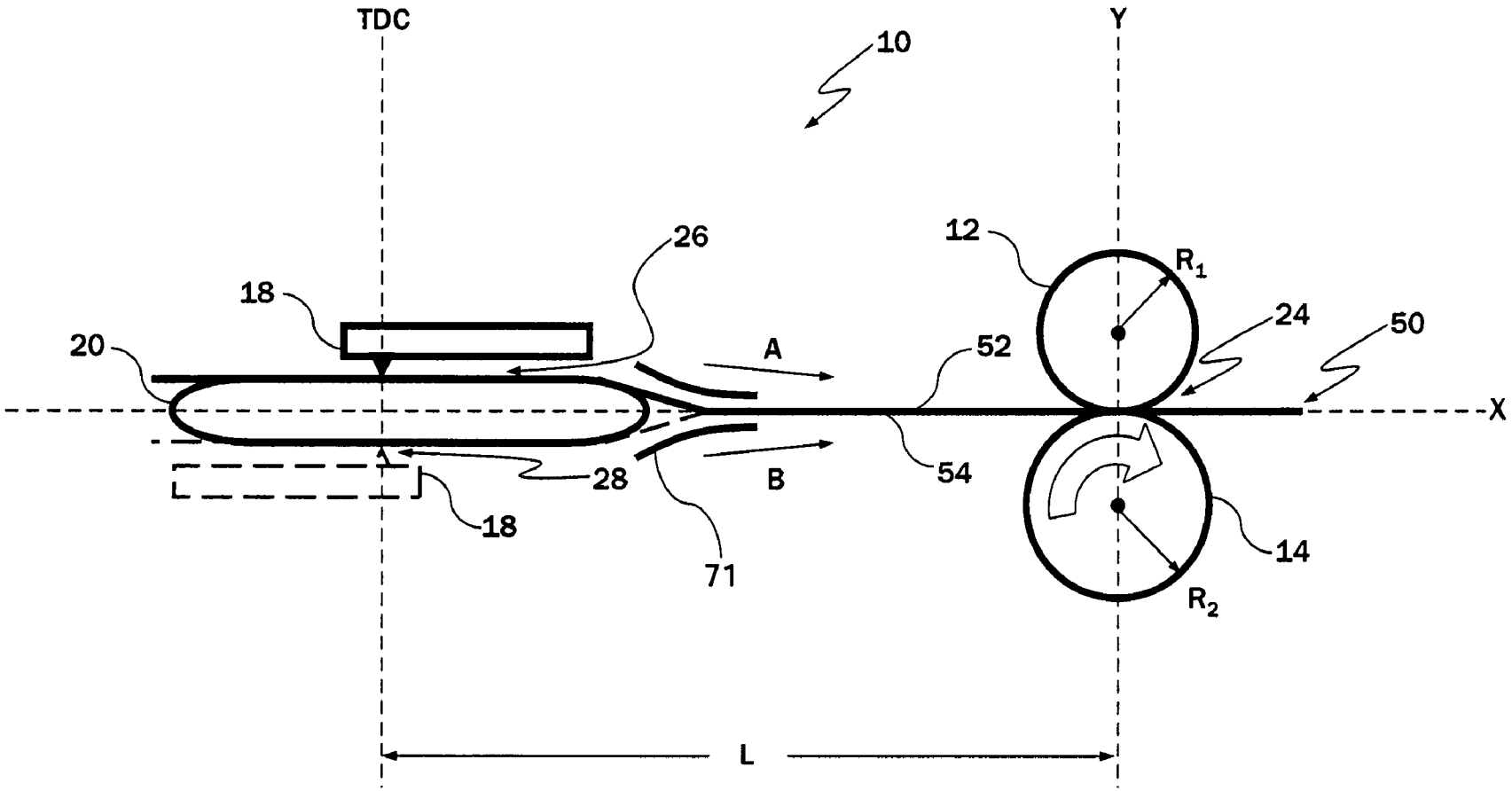
FIG. 14 is a schematic diagram of an embodiment of a printing device according to the invention which includes a non-rotating platen in association with a thermal print head.

FIG. 14 is a schematic diagram of a configuration of a thermal printing device 10 with a substantially straight media path through the driving nip 24 in accordance with another embodiment of the present invention. In this embodiment, the platen 20 is non-rotating and guide rollers are replaced by guide channels 71 for directing the imaging member 50 into the A path or the B path. As should be readily understood from this embodiment and the embodiments in FIGS. 6 and 7, any modification of the roller or channel for directing the imaging member 50 into the driving nip 24 such that it enters the driving nip 24 in a substantially perpendicular manner relative to the axis Y would achieve substantially the same result.

As described above, a thermal printing device 10 such as that illustrated in FIG. 1, in which the print head subassembly 18 is moved from one position to another in order to print on both sides of an imaging member 50 in two separate printing passes, must be designed so that the transport of the imaging member is substantially the same for both printing passes. It is also necessary that the alignment of the thermal print head subassembly 18 with respect to the imaging member 50 be optimal for high-quality printing during each printing pass.

The embodiments described herein are intended to be illustrative of this invention. As will be recognized by those of ordinary skill in the art, various modifications and changes can be made to these embodiments and such variations and modifications would remain within the spirit and scope of the invention defined in the appended claims and their equivalents. Additional advantages and modifications will readily occur to those of ordinary skill in the art. Therefore, the invention in its broader aspects is not limited to the specific details and representative embodiments shown and described herein.

What is claimed is:

1. A printing device comprising:

a platen for supporting during a printing operation an imaging member having first and second opposed surfaces;

at least one driving roller for driving said imaging member;

at least one print head subassembly comprising at least one thermal print head for direct thermal printing on said imaging member, said at least one print head subassembly being configured to be movable independently of said platen for printing on a first surface of said imaging member in a first position in a first transport path of said imaging member and on a second surface of said imaging member in a second position in a second transport path of said imaging member; and a second roller in contact with said imaging member on the opposite surface to that contacted by said driving roller, said second roller being in a different position for one of said first and second transport paths than it is for the other of said first and second transport paths;

wherein the distance of transport of said imaging member for a given angular rotation of said driving roller is substantially the same for said first transport path and said second transport path.

2. The printing device of claim 1, in which the degree of wrap of said imaging member around said driving roller is substantially the same for said first transport path and said second transport path.

3. The printing device of claim 1, in which the strain in said imaging member when in contact with said driving roller is substantially the same for said first transport path and said second transport path.

4. The printing device of claim 1 wherein the surface of said second roller is sufficiently deformable such that said distance of transport of said imaging member is substantially the same for said first and second transport paths.

5. The printing device of claim 1 wherein the surface of said imaging member is substantially perpendicular to the plane containing the rotational axes of said driving roller and said second roller at a line of contact between said imaging member and said driving roller.

6. The printing device of claim 1 wherein said platen is a non-rotating platen.

7. The printing device of claim 1 wherein said movement of said print head subassembly is a rotational movement from said first position to said second position.

8. The printing device of claim 7 wherein said rotational movement is approximately 180 degrees.

9. A printing device comprising:

a platen for supporting during a printing operation an imaging member having first and second opposed surfaces;

at least one driving roller for driving said imaging member;

at least one print head subassembly comprising at least one thermal print head for direct thermal printing on said imaging member, said at least one print head subassembly being configured to be movable independently of said platen for printing on a first surface of said imaging member in a first position in a first transport path of said imaging member and on a second surface of said imaging member in a second position in a second transport path of said imaging member; and guide means positioned between said driving roller and said platen;

wherein the distance of transport of said imaging member for a given angular rotation of said driving roller is substantially the same for said first transport path and said second transport path.

* * * * *